US008606128B2

(12) United States Patent
Takenaka

(10) Patent No.: US 8,606,128 B2
(45) Date of Patent: Dec. 10, 2013

(54) IMAGE FORMING APPARATUS AND METHOD OF CONTROLLING IMAGE FORMING APPARATUS FOR MORE EFFICIENT PRINTING

(75) Inventor: Sunao Takenaka, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 301 days.

(21) Appl. No.: 13/098,614

(22) Filed: May 2, 2011

(65) Prior Publication Data

US 2011/0280602 A1 Nov. 17, 2011

Related U.S. Application Data

(60) Provisional application No. 61/333,374, filed on May 11, 2010.

(51) Int. Cl.

| | |
|---|---|
| ***G03G 15/00*** | (2006.01) |
| ***G03G 15/02*** | (2006.01) |
| ***G03G 15/06*** | (2006.01) |
| ***G03G 15/20*** | (2006.01) |

(52) U.S. Cl.
USPC ..... 399/45; 399/50; 399/55; 399/66; 399/69; 399/81

(58) Field of Classification Search
USPC ..... 399/45, 66, 55, 56, 53, 50, 69, 81
See application file for complete search history.

(56) References Cited

U.S. PATENT DOCUMENTS

| | | | | |
|---|---|---|---|---|
| 5,887,219 | A * | 3/1999 | Eom | 399/45 |
| 5,966,559 | A * | 10/1999 | May et al. | 399/45 |
| 6,002,891 | A * | 12/1999 | Shin | 399/45 |
| 8,208,823 | B2 * | 6/2012 | Yoshioka | 399/45 |
| 2004/0190919 | A1 * | 9/2004 | Iwasaki et al. | 399/66 |
| 2005/0259283 | A1 * | 11/2005 | Hattori et al. | 399/45 |
| 2007/0147861 | A1 * | 6/2007 | Takayanagi | 399/45 |
| 2009/0103934 | A1 | 4/2009 | Murakami | |
| 2009/0142083 | A1 * | 6/2009 | Minbu | 399/66 |
| 2010/0142982 | A1 * | 6/2010 | Moore et al. | 399/45 |
| 2010/0150588 | A1 * | 6/2010 | Kaneyama et al. | 399/66 |

FOREIGN PATENT DOCUMENTS

| | | | |
|---|---|---|---|
| JP | 04355486 | A * | 12/1992 |
| JP | 06019341 | A * | 1/1994 |
| JP | 07104586 | A * | 4/1995 |
| JP | 07261577 | A * | 10/1995 |
| JP | 09-304979 | | 11/1997 |
| JP | 2002049249 | A * | 2/2002 |
| JP | 2008122626 | A * | 5/2008 |

* cited by examiner

*Primary Examiner* — Susan Lee
(74) *Attorney, Agent, or Firm* — Turocy & Watson, LLP

(57) ABSTRACT

An image forming apparatus according to an embodiment includes a charging device that charges an electric charge to an image carrier, a developing device supplying the image carrier with a developer, and a transfer device that transfers a toner image formed on the image carrier by a developing device onto a recording medium. The apparatus further includes a control unit, discriminates between a first mode of forming an image on a first recording medium of a first thickness and a second mode of forming an image on a second recording medium thinner than the first recording medium to control a developing contrast electric potential, and controls a magnitude of the developing contrast electric potential in the second mode so as to be lower than the first mode.

14 Claims, 3 Drawing Sheets

IMAGE FORMING APPARATUS AND METHOD OF CONTROLLING IMAGE FORMING APPARATUS FOR MORE EFFICIENT PRINTING

CROSS-REFERENCE TO RELATED APPLICATION

This application is based upon and claims the priority of U.S. Provisional Application No. 61/333,374, filed on May 11, 2010, the entire contents of which are incorporated herein by reference.

FIELD

Embodiments described herein relate to an image forming apparatus that forms an image on a recording medium such as a sheet of paper, and a method of controlling the image forming apparatus.

BACKGROUND

In an image forming apparatus such as a copier of an electrophotographic type, an image is formed on a recording medium (a sheet of paper and the like) by a cycle of charging, exposing, developing, and transferring. For example, a surface of a photoconductive drum is similarly charged, a laser beam is radiated to the charged photoconductive drum to form an electrostatic latent image, and the electrostatic latent image of the photoconductive drum is developed by a developing device to form a toner image.

The toner image of the photoconductive drum is primary transferred to a rotating intermediate transfer belt and the like, and the toner image is secondary transferred onto the sheet. The sheet, onto which the toner image is transferred, is heated by a fixer and a toner image is fixed on the sheet. The sheet, to which the toner image is fixed, is discharged by a transport roller.

Incidentally, in the image forming apparatus of the related art, an image can be formed on various recording media such as thick sheet, coated sheet, and thin sheet. Meanwhile, in order to be compatible with various recording media, an engine of the image forming apparatus needs to be designed so as to cope with the respective media. However, it is difficult to cope with various media from a thin sheet to a thick sheet with one engine.

Especially, in the printing on the thin sheet, a sheet may be wound around the fixer, or a sheet may be wound around a transfer belt or a transfer roller. In order to avoid the winding of the sheet, it is also considered to provide a transfer peeling portion or to provide a peeling claw in the fixer to facilitate the peeling, but there is a possibility that a claw mark is left on the sheet, which leads to an increase in costs.

DETAILED DESCRIPTION

Figure 1:
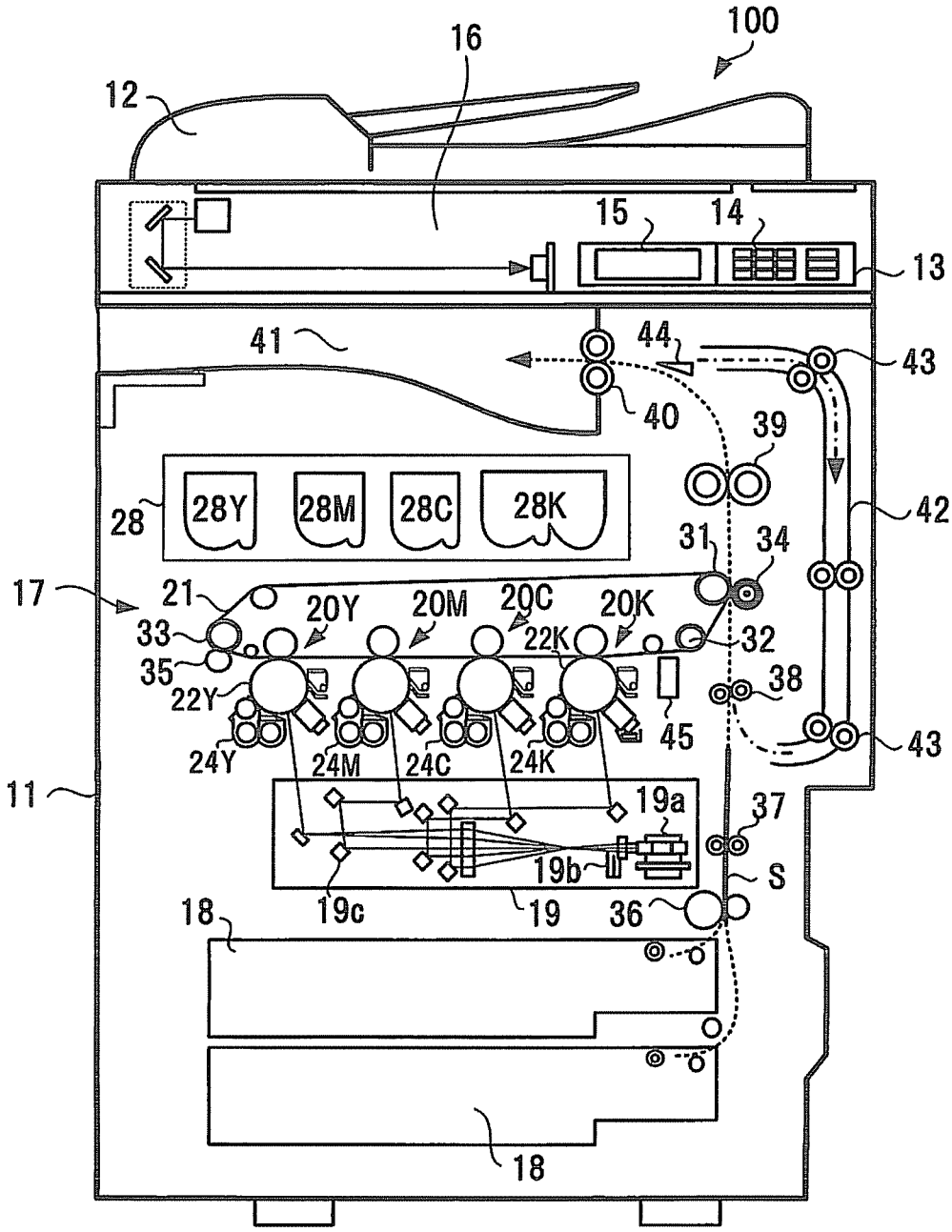
FIG. 1 illustrates a configuration diagram of an image forming apparatus according to an embodiment.

An image forming apparatus according an embodiment including:

an image carrier which is irradiated with a laser beam to form an electrostatic latent image, a charging device that charges an electric charge to the image carrier, a developing device that includes a developing roller supplying the image carrier with a developer, a transfer device that transfers a toner image formed on the image carrier by the developing device onto a recording medium, a fixing device that fixes the toner image to the recording medium onto which the toner image is transferred, and a control unit that discriminates between a first mode of forming an image on a first recording medium of a first thickness and a second mode of forming an image on a second recording medium thinner than the first recording medium to control a developing contrast electric potential which is difference between a developing bias electric potential and a exposure electric potential, and lowers a magnitude of the developing contrast electric potential in the second mode further than the first mode.

Hereinafter, an image forming apparatus according to an embodiment will be described with reference to the drawings. Furthermore, the same portions in each drawing will be denoted by the same reference numerals.

FIG. 1 illustrates a configuration diagram of an image forming apparatus according to an embodiment. The image forming apparatus 100 is, for example, an MFP (Multi-Function Peripherals) that is a combined machine, a printer, a copier, or the like. In the following description, the MFP is described as an example.

A document table exists in an upper portion of a main body 11 of the MFP 100, and an automatic document feeder (ADF) 12 is provided on the document table in a freely openable and closable manner. Furthermore, an operation unit 13 is provided on an upper portion of the main body 11. The operation unit 13 has various operation keys 14, and a touch panel type display unit 15.

A scanner unit 16 is provided in a lower portion of the ADF 12 of the main body 11. The scanner unit 16 reads a document transported by the ADF 12 or a document placed on the document table to create an image data. A printer unit 17 is included in a center portion in the main body 11, and a plurality of cassettes 18 accommodating various sizes of sheet is included in the lower portion of the main body 11.

The printer unit 17 includes a photoconductive drum, laser, and the like, processes an image data read by the scanner unit 16 or an image data made by a PC (Personal Computer) and the like, and fixes an image to a sheet that is a recording medium. The sheet, to which an image is fixed by the printer unit 17, is discharged to the discharge portion 41.

The printer unit 17 is, for example, a color laser printer of a tandem method, scans a photoconductor by a laser beam from a laser exposure device 19, and forms an image. The printer unit 17 includes image forming sections 20Y, 20M, 20C, and 20K of each color of yellow (Y), magenta (M), cyan (C), and black (K). The image forming sections 20Y, 20M, 20C, and 20K are disposed in a lower side of the transfer belt 21 from an upstream to a downstream side in parallel. Since the respective image forming sections 20Y, 20M, 20C, and 20K have the same configurations, a configuration of the image forming section 20K will be representatively described.

Figure 2:
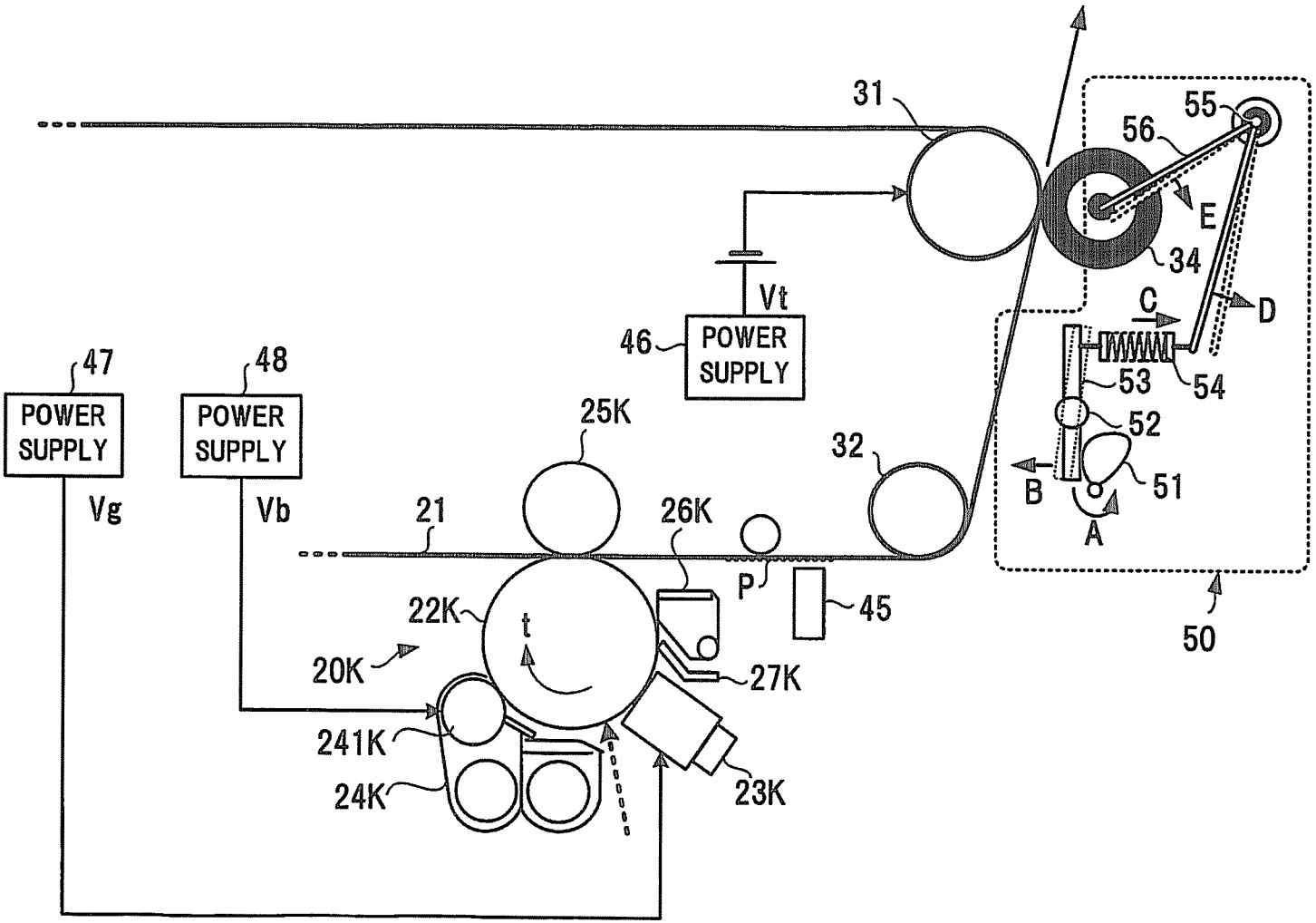
FIG. 2 illustrates an enlarged configuration diagram of an image forming section and a transfer portion.

FIG. 2 illustrates an enlarged configuration diagram of the image forming section 20K. The image forming section 20K has a photoconductive drum 22K that is an image carrier. A charging device 23K, a developing device 24K, a primary transfer roller 25K, a cleaner 26K, a blade 27K, or the like are disposed around the photoconductive drum 22K along a rotation direction t. A laser beam is radiated from a laser exposure device 19 to an exposure position of the photoconductive drum 22K, thereby forming an electrostatic latent image on the photoconductive drum 22K.

The charging device 23K similarly charges the entire surface of the photoconductive drum 22K. The developing device 24K has a mixer that stirs the developer, and has a developing roller 241K to which a developing bias is applied, and supplies a toner of two component developers formed of a toner and a carrier to the photoconductive drum 22K by the developing roller 241K. The cleaner 26K removes a residual toner on the surface of the photoconductive drum 22K using the blade 27K.

As shown in FIG. 1, on the upper portion of the image forming sections 20Y, 20M, 20C, and 20K, a developer cartridge 28 is provided which supplies the developer to the developing devices 24Y, 24M, 24C, and 24K. In the developer cartridge 28, developer cartridges 28Y, 28M, 28C, and 28K of each color of yellow (Y), magenta (M), cyan (C), and black (K) are adjacent to each other.

Returning to FIG. 1, the transfer belt 21 is circularly moved, and for example, semi-conductive polyimide is used as the transfer belt 21 in view of a heat resistance and an abrasion resistance. The transfer belt 21 is extended around a driving roller 31 and driven rollers 32 and 33, and the transfer belt 21 oppositely comes into contact with the photoconductive drums 22Y, 22M, 22C, and 22K. As shown in FIG. 2, a primary transfer voltage is applied to a position of the transfer belt 21 facing the photoconductive drum 22K by the primary transfer roller 25K, thereby primary transferring the toner image (the developer image) on the photoconductive drum 22K onto the transfer belt 21.

A secondary transfer roller 34 is oppositely disposed in the driving roller 31 over which the transfer belt 21 is extended. The driving roller 31 and the secondary transfer roller 34 constitute transfer members. When the sheet S passes through between the driving roller 31 and the secondary transfer roller 34, the transfer bias is applied to secondary transfer the toner image on the transfer belt 21 onto the sheet S. A belt cleanser 35 is provided near the driven roller 33 of the transfer belt 21.

The laser exposure device 19 includes a polygon mirror 19*a*, an imaging lens system 19*b*, a mirror 19*c* or the like, and scans the laser beam emitted from a semiconductor laser element in an axial direction of the photoconductive drums 22Y to 22K. Between the sheet feeding cassette 18 and the secondary transfer roller 34, a separation roller 36 that draws out the sheet S in the sheet feeding cassette 18, a transport roller 37, and resist roller 38 are provided, and a fixer 39 is provided to the downstream of the secondary transfer roller 34.

A sheet discharging roller 40 is provided to the downstream of the fixer 39 to discharge the sheet S to a sheet discharge portion 41. Furthermore, a reversal transport path 42 is provided. Since the reversal transport path 42 has a plurality of transport rollers 43 and reverses the sheet S to guide the sheet S in the direction of the secondary transfer roller 34, the reversal transport path 42 is used when performing double-sided printing. The sheet S passed through the fixer 39 is guided to the sheet discharging portion 41 or the reversal transport path 42 by a distribution gate 44.

Furthermore, as shown in FIG. 2, to the downstream of the photoconductive drum 22K, a sensor 45 is provided which reads an adjusting pattern P printed on the transfer belt 21. The senor 45 detects the toner attachment amount on the photoconductive drum 22K by reading the adjusting pattern P.

The operation of the image forming apparatus 100 of FIG. 1 will be described simply. When the image data is input from the scanner 16, a PC, or the like, images are sequentially formed by the respective image forming sections 20Y to 20K. When describing the image forming section 20K as an example, the photoconductive drum 22K is irradiated with a laser beam corresponding to the image data of black (K) and an electrostatic latent image is formed thereon. In addition, the electrostatic latent image of the photoconductive drum 22K is developed by the developing device 24K and the toner image (the developer image) of black (K) is formed.

The photoconductive drum 22K comes into contact with the rotating transfer belt 21 and primary transfers the toner image of black (K) onto the transfer belt 21. The residual toner of the photoconductive drum 22K after the toner image is primary transferred is removed by the cleaner 26K and the blade 27K, whereby the next image formation is possible.

Similarly to the toner image forming process of black (K), the toner images of yellow (Y), magenta (M), and cyan (C) are formed by the image forming sections 20Y, 20M and 20C of the preceding stage, and the toner images of each color are sequentially transferred to the same positions on the transfer belt 21, whereby the toner images of full colors can be obtained.

The transfer belt 21 collectively and secondarily transfers the full color toner images onto the sheet S by the secondary transfer roller 34. Synchronized with the time when the full color toner images on the transfer belt 21 reach the secondary transfer roller 34, the sheet S is supplied from the sheet feeding cassette 18 to the secondary transfer roller 34. The sheet S, onto which the toner image is secondary transferred, reaches the fixer 39 and fixes the toner image. The sheet S, on which the toner image is fixed, is discharged to the sheet discharging portion 41. Meanwhile, in the transfer belt 21, after the secondary transfer is finished, the residual toner is cleaned by the belt cleanser 35.

Next, the adjustment of the toner attachment amount of the image forming apparatus 100 according to an embodiment will be described. Furthermore, in the following description, the description will be given while omitting the reference numerals of Y, M, C, and K. In order to adjust the attachment amount of the toner, the adjusting pattern P is printed on the transfer belt 21. The printed adjusting pattern P is read by the sensor 45 (FIG. 1). As the sensor 45, for example, a CCD sensor, a CMOS sensor, or the like are used. The toner attachment amount is automatically adjusted by discriminating the density of the adjusting pattern P.

Furthermore, as shown in FIG. 2, a bias Vt is supplied from a power supply circuit 46 to the driving roller 31, whereby the transfer bias is adjusted by varying the bias Vt. In order to similarly charge all the surface of the photoconductive drum 22, a charging bias Vg is supplied from a power supply circuit 47 to the charging device 23. Furthermore, a developing bias Vb is supplied from a power supply circuit 48 to the developing roller 241 of the developing device 24.

Furthermore, in order to control the pressing state in the transfer portion (the driving roller 31 and the secondary transfer roller 34) due to the secondary transfer roller 34, a pressing control unit 50 is provided. The secondary transfer roller 34 is a pressing roller, and presses the sheet S to a surface with the toner image formed thereon, that is, to the transfer belt 21.

The pressing control unit 50 includes a rotation cam 51, an arm 53 rotating around the shaft 52 as a support point, a spring 54, and a pressing member 56 rotating around a support point 55. The pressing member 56 presses the secondary transfer roller 34 (a pressing roller) to the driving roller 31 side, and relieves the pressing to the driving roller 31 to control the pressing state.

Furthermore, the printing mode can be set by operating the operation unit 13. For example, a mode (a first mode) of printing a sheet having a standard first thickness or a mode (a second mode) of printing a sheet having a thickness thinner than the first thickness are selected.

In the first mode of printing the sheet of the first thickness, the adjusting pattern P is printed at a preset density, and the printer unit 17 sets a density objective value based on the adjusting pattern P and carries out the printing so that an image density ID is increased. That is, the charging bias Vg and the developing bias Vb are controlled to a preset value, so that the developing contrast becomes a standard value, the attachment amount of the toner image to the photoconductive drum 22 and the transfer belt 21 is adjusted, the pressing of the secondary transfer roller 34 is increased, and the bias Vt is controlled.

Meanwhile, in the second mode of printing the thin sheet, the density of the adjusting pattern P printed on the transfer belt 21 is lowered. The sensor 45 reads the adjusting pattern P, but, in the second printing mode, an objective density of the adjusting pattern P is set to be lower than the first mode time.

Thus, the printer unit 17 controls the charging bias Vg and the developing bias Vb based on the adjusting pattern P read by the sensor 45, lowers the magnitude of the developing contrast electric potential further than the first mode, reduces the attachment amount of the toner, and lowers the image density ID. Furthermore, the pressing of the secondary transfer roller 34 in the transfer roller (the driving roller 31 and the secondary transfer roller 34) is lowered, or the bias Vt is lowered. Otherwise, the pressing of the secondary transfer roller 34 is lowered, and the bias Vt is lowered.

That is, when the second mode is selected, the developing contrast electric potential to be determined by the developing bias and the charging bias is lowered, and the attachment amount of the toner is controlled so as to be lower than the first mode. For example, the bias necessary for the solid printing in the first mode is assumed to be a standard value, in the second mode, the bias is lowered to the bias necessary for the half tone darker than the standard value.

Figure 3A:
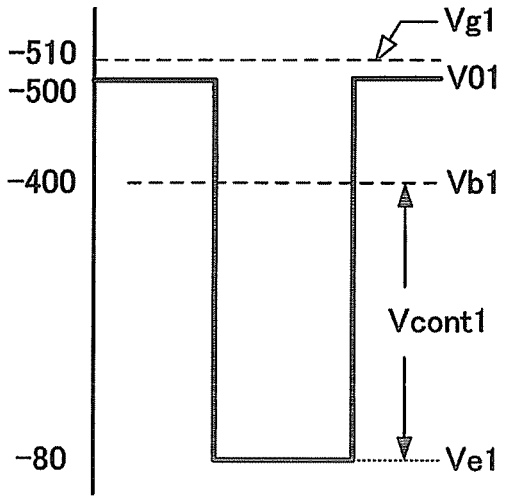
FIGS. 3A and 3B illustrate an explanatory diagram that describes the control of a developing contrast electric potential.
Figure 3B:
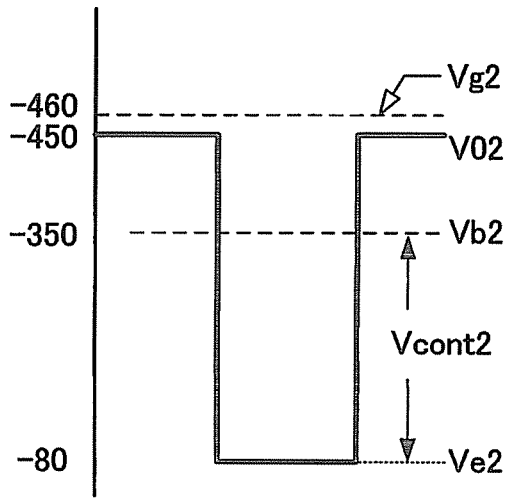

FIGS. 3A and 3B illustrate diagrams of the developing contrast electric potentials in the first mode and the second mode. In FIG. 3A, a longitudinal axis shows a voltage, the charging electric potential of the photoconductive drum 22 by the charging bias Vg1 to the photoconductive drum 22 is V01, the developing bias electric potential is Vb1, and the exposure electric potential is Ve1. Furthermore, in FIG. 3B, a longitudinal axis shows a voltage, the charging electric potential of the photoconductive drum 22 by the charging bias Vg2 to the photoconductive drum 22 is V02, the developing bias electric potential is Vb2, and the exposure electric potential is Ve2.

In the first mode, for example, V01=−500 volts, Vb1=−400 volts, and Ve1=−80 volts. The developing contrast electric potential Vcont1 is indicated by a difference between Vb1 and Ve1 and is 320 volts. Usually, in the first mode, the developing contrast electric potential Vcont1 is about 300 to 350 volts.

Meanwhile, in the second mode, for example, V02=−450 volts, Vb2=−350 volts, and Ve2=−80 volts. The developing contrast electric potential Vcont2 (=Vb2−Ve2) is reduced to 270 volts. That is, in the second mode, the developing contrast electric potential Vcont2 is about 250 to 300 volts.

In the second mode, the magnitude of the developing contrast electric potential Vcont2 is reduced, whereby the attachment amount of the toner to the transfer belt 21 is reduced. Thus, since the toner amount of the thin sheet S is also reduced, possible to prevent the sheet from being wound around the transfer roller 21 or the secondary transfer roller 34 (or the driving roller 31). Furthermore, the sheet is also prevented from being wound around the fixing device 39.

Furthermore, in the second mode, the bias Vt is also set to be lower than the normal mode, thereby lowering the transfer bias and lowering the pressing state due to the secondary transfer roller 34 in the transfer portion. That is, in the second mode, as shown in FIG. 2, the cam 51 of the pressing control unit 50 is rotated in an A direction, and an end (a lower end) of the arm 53 is pushed in an arrow B direction. The other end (an upper end) of the arm 53 is rotated in an arrow C direction, which pushes the spring 54 to move an end of the pressing member 56 in a D direction. When an end of the pressing member 56 is moved in the ID direction, the other end of the pressing member 56 is moved around the support point 55 in an arrow E direction, and the secondary transfer roller 34 is moved in a direction of being separated from the driving roller 31, thereby relieving the pressing strength due to the secondary transfer roller 34 (the pressing roller)

Thus, the pressing strength due to the transfer bias or the secondary transfer roller 34 is relieved, whereby possible to prevent the thin sheet from being wound around the secondary transfer roller 34 or the driving roller 31.

Figure 4:
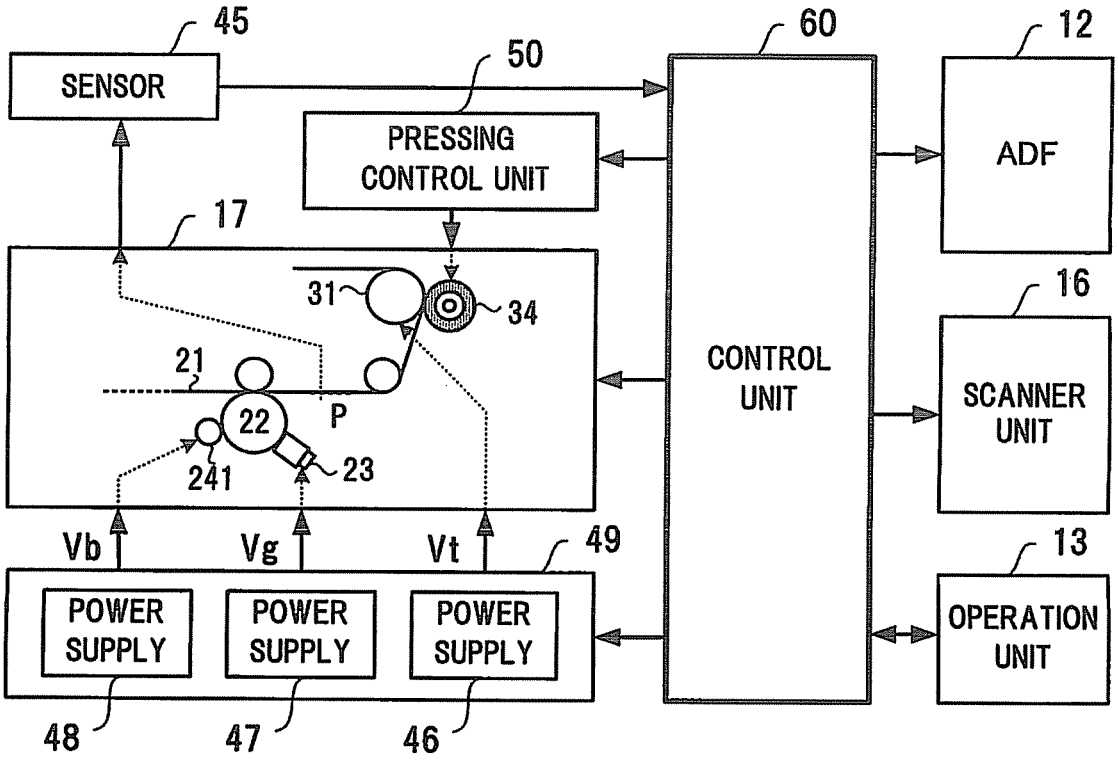
FIG. 4 illustrates a block diagram of a control system of an image forming apparatus.

FIG. 4 illustrates a block diagram of a control system of an image forming apparatus according to an embodiment. The control unit 60 controls the operation of the image forming apparatus 100. The control unit 60 includes a CPU, a ROM or the like, and controls each portion of the image forming apparatus 100, for example, an ADF 12, a scanner unit 16, and a printer unit 17 according to a control program recorded on the ROM.

The data of the adjusting pattern P read by the sensor 45 is input to the control unit 60, and the control unit 60 sets a density objective value based on the adjusting pattern P and controls the printer unit 17. That is, a power supply unit 49 including power supply circuits 46, 47, and 48 is connected to the printer unit 17, and the bias Vt, the charging bias Vg, and the developing bias Vb depending on the first mode and the second mode are supplied to the printer unit 17.

The discrimination between the first mode and the second mode can be performed by operating the operation unit 13 by a user to select the mode. Otherwise, a media sensor may be provided to discriminate the thickness of the sheet, so that the first mode and the second mode are discriminated.

Furthermore, the control unit 60 controls the pressing control unit 50 and raises the pressing strength due to the secondary transfer roller 34 in the first mode. Furthermore, in the second mode, the control unit 60 relieves the pressing strength due to the secondary transfer roller 34.

According to the embodiment as mentioned above, since the winding of the sheet to the transfer portion is suppressed and the maximum toner attachment amount to the sheet is suppressed, the winding to the fixing device is also suppressed.

Moreover, various modifications can be made without being limited to the above embodiments. For example, in the second mode, the fixing temperature of the fixing device 39 may be lowered. In the second mode, since the attachment amount of the toner is dropped, there is no problem even if the fixing temperature is slightly lowered.

While certain embodiments have been described, these embodiments have been presented by way of example only, and are not intended to limit the scope of the invention. Indeed, the novel apparatus and methods described herein may be embodied in a variety of other forms; furthermore, various omissions, substitutions, and changes in the form of the apparatus and methods described herein may be made without departing from the spirit of the inventions. The accompanying claims and their equivalents are intended to cover such forms or modifications as would fall within the scope and the spirit of the inventions.

What is claimed is:

1. An image forming apparatus comprising:

an image carrier which is irradiated with a laser beam to form an electrostatic latent image, a charging device that charges an electric charge to the image carrier, a developing device that includes a developing roller supplying the image carrier with a developer, a transfer device that transfers a toner image formed on the image carrier by the developing device onto a recording medium, a fixing device that fixes the toner image to the recording medium onto which the toner image is transferred, and a control unit that discriminates between a first mode of forming an image on a first recording medium of a first thickness and a second mode of forming an image on a second recording medium thinner than the first recording medium to control a developing contrast electric potential which is a difference between a developing bias electric potential and a exposure electric potential, and lowers a magnitude of the developing contrast electric potential in the second mode further than the first mode.

2. The apparatus of claim 1, wherein the control unit controls a charging bias of the charging device and a developing bias of the developing roller, lowers the charging bias and the developing bias in the second mode further than the first mode, and lowers the magnitude of the developing contrast electric potential.

3. The apparatus of claim 1, further comprising:

a sensor that detects an attachment amount of toner on the image carrier, wherein the control unit sets density objective values in the first mode and the second mode based on data detected by the sensor, and controls the developing contrast electric potential so as to be close to the density objective value in each mode.

4. The apparatus of claim 1, wherein the control unit controls a transfer bias when transferring the toner onto the recording medium in the second mode so as to be lower than the first mode.

5. The apparatus of claim 1, wherein the transfer device includes a pressing roller that presses the recording medium against a surface formed with the toner image, and a pressing control unit that controls the pressing state of the pressing roller, and wherein the pressing control unit relieves the pressing strength of the pressing roller in the second mode further than the first mode.

6. The apparatus of claim 1, wherein the control unit lowers a fixing temperature due to the fixing device in the second mode further than the first mode.

7. The apparatus of claim 1, further comprising:

an operation unit that is operable by a user, wherein the first mode or the second mode is selected by the operation of the operation unit.

8. A method of controlling an image forming apparatus comprising:

charging an electric charge to an image carrier by a charging device, irradiating the image carrier with a laser beam to form an electrostatic latent image, supplying the image carrier with a developer by a developing device including a developing roller, transferring a toner image formed on the image carrier by the developing device onto a recording medium, fixing the toner image to the recording medium onto which the toner image is transferred by a fixing device, discriminating between a first mode of forming an image on a first recording medium of a first thickness and a second mode of forming an image on a second recording medium thinner than the first recording medium, and controlling a magnitude of a developing contrast electric potential which is a difference between a developing bias electric potential and a exposure electric potential in the second mode so as to be lower than the first mode.

9. The method of claim 8, wherein a charging bias of the charging device and a developing bias of the developing roller are controlled, the charging bias and the developing bias in the second mode are lowered further than the first mode, and the magnitude of the developing contrast electric potential is lowered.

10. The method of claim 8, further comprising:

detecting an attachment amount of toner on the image carrier by a sensor, setting density objective values in the first mode and the second mode based on data detected by the sensor, thereby controlling the developing contrast electric potential so as to be close to the density objective values in each mode.

11. The method of claim 8, wherein a transfer bias when transferring the toner image onto the recording medium in the second mode is controlled so as to be lower than the first mode.

12. The method of claim 8, wherein, when transferring the toner image onto the recording medium, the recording medium is pressed against a surface formed with the toner image by a pressing roller, and the pressing strength of the pressing roller in the second mode is relieved further than the first mode.

13. The method of claim 8, wherein a fixing temperature due to the fixing device in the second mode is reduced further than the first mode.

14. The method of claim 8, wherein an operation unit that is operable by a user is provided, and the first mode or the second mode is selected by the operation of the operation unit.

* * * * *